US008057663B2

(12) United States Patent
Stell et al.

(10) Patent No.: US 8,057,663 B2
(45) Date of Patent: Nov. 15, 2011

(54) METHOD AND APPARATUS FOR RECYCLE OF KNOCKOUT DRUM BOTTOMS

(75) Inventors: Richard C. Stell, Houston, TX (US); David B. Spicer, Houston, TX (US); George Stephens, Huffman, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 400 days.

(21) Appl. No.: 12/474,801

(22) Filed: May 29, 2009

(65) Prior Publication Data

US 2010/0300936 A1 Dec. 2, 2010

(51) Int. Cl.
*C10G 9/36* (2006.01)

(52) U.S. Cl. ..... 208/130; 208/128; 208/132; 585/648; 585/652

(58) Field of Classification Search ..... 208/128, 208/130, 132; 585/648, 652
See application file for complete search history.

(56) References Cited

U.S. PATENT DOCUMENTS 3,617,493 A 11/1971 Wirth et al.
3,718,709 A 2/1973 Simonetta
6,773,818 B2 8/2004 Cretekos et al.
6,893,722 B2 5/2005 McGee
7,090,765 B2 8/2006 Spicer et al.
7,097,758 B2 8/2006 Stell et al.
7,138,047 B2 11/2006 Stell et al.
7,193,123 B2 3/2007 Stell et al.
7,195,818 B2 3/2007 Kong et al.
7,220,887 B2 5/2007 Stell et al.
7,235,705 B2 6/2007 Stell
7,244,871 B2 7/2007 Stell et al.
7,247,765 B2 7/2007 Stell et al.
7,285,697 B2 10/2007 Keusenkothen
7,297,833 B2 11/2007 Beattie et al.
7,311,746 B2 12/2007 Stell et al.
7,312,371 B2 12/2007 Stell et al.
7,351,872 B2 4/2008 Stell et al.
7,358,413 B2 4/2008 Stell et al.
7,371,465 B2 5/2008 Pellingra et al.
7,402,237 B2 7/2008 McCoy et al.
7,408,093 B2 8/2008 Stell et al.
7,419,584 B2 9/2008 Stell et al.
7,481,871 B2 1/2009 Frye et al.
7,820,035 B2 10/2010 McCoy et al.
2005/0261531 A1* 11/2005 Stell et al. ..... 585/648
2005/0261533 A1* 11/2005 Stell et al. ..... 585/648
2008/0283445 A1* 11/2008 Powers ..... 208/85

* cited by examiner

*Primary Examiner* — Walter Griffin
*Assistant Examiner* — Brian McCaig

(57) ABSTRACT

A process and apparatus for cracking a hydrocarbon feed in a steam cracking furnace by withdrawing a resid-rich stream from a resid knockout vessel and recycling the resid-rich stream through a convection heating section of the furnace.

11 Claims, 1 Drawing Sheet

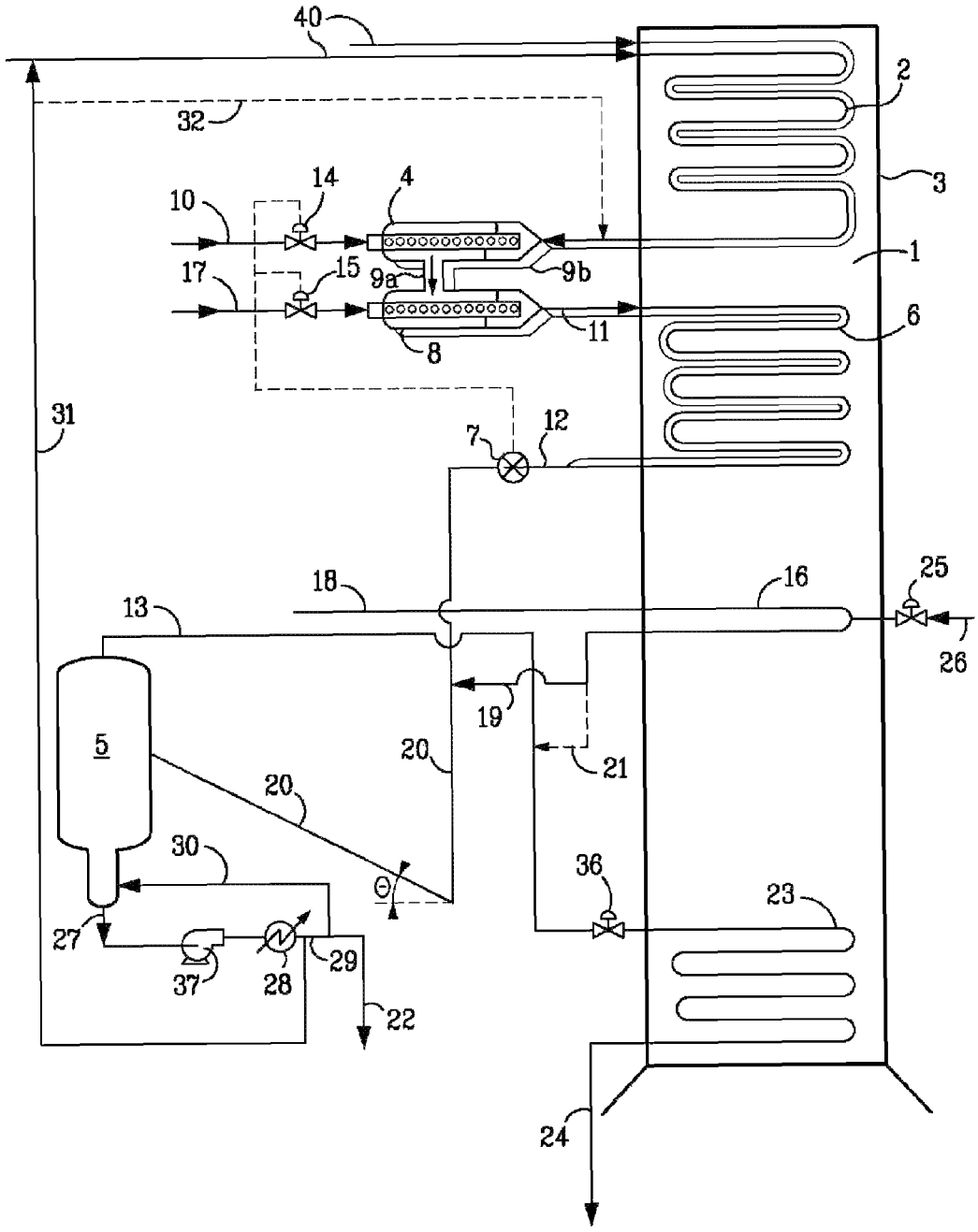
40
2
32
3
14
4
10
1
17
15
9a
9b
6
11
8
31
7
12
18
16
25
13
26
19
5
20
21
20
30
36
23
Θ
27
29
37
28
22
24

METHOD AND APPARATUS FOR RECYCLE OF KNOCKOUT DRUM BOTTOMS

FIELD

This invention relates to a process for cracking a hydrocarbon feed in a steam cracking furnace by recycling resid extracted from a resid knockout vessel.

BACKGROUND

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace that has two main sections: a convection heating section and a radiant (or "pyrolysis") section. The hydrocarbon feedstock typically enters the convection heating section of the furnace as a liquid (except for light feedstocks which enter as a vapor) wherein it is heated and vaporized by indirect contact with hot flue gas from the radiant section and by direct contact with steam. The vaporized feedstock and steam mixture is then introduced into the radiant section where the cracking takes place. The resulting products including olefins leave the pyrolysis furnace for further downstream processing, including quenching.

Conventional steam cracking systems have been effective for cracking a high-quality feedstock which contains a large fraction of volatile hydrocarbons, such as gas oil and naphtha. However, steam cracking economics sometimes favor cracking lower cost feedstocks containing resids such as, by way of non-limiting examples, atmospheric residue, e.g., atmospheric pipestill bottoms, and crude oil. Crude oil and atmospheric residue often contain high molecular weight, non-volatile components with boiling points, for example such as in excess of 590° C. (1100° F.). The term resid however generally include the heaviest streams or fractions in a distillation or separation process, e.g., the bottom stream from a vapor-liquid separator or distillation tower, the exact nature of which will depend upon the separation temperatures within the vessel and hence is not necessarily limited merely to one specific cut-off temperature. Over time, portions of the non-volatile components of resid-containing feedstocks lay down as coke in the convection section of conventional pyrolysis furnaces. Only very low levels of non-volatile components can be tolerated in the convection heating section downstream of the point where the lighter components have fully vaporized.

Additionally, cracking heavier feeds, such as kerosenes and gas oils, produces larger amounts of tar, which can lead to rapid coking in the radiant section of the furnace as well as fouling in the transfer line exchangers preferred in lighter liquid cracking service.

To address coking problems, U.S. Pat. No. 3,617,493, which is incorporated herein by reference, discloses the use of an external vaporization drum for the crude oil feed and discloses the use of a first flash to remove naphtha as vapor and a second flash to remove vapors with a boiling point between 230° C. and 590° C. (450° F. and 1100° F.). The vapors are cracked in the pyrolysis furnace into olefins and the separated liquids from the two flash tanks are removed, stripped with steam, and used as fuel.

U.S. Pat. No. 3,718,709, which is incorporated herein by reference, discloses a process to minimize coke deposition. It describes preheating of heavy feedstock inside or outside a pyrolysis furnace to vaporize about 50% of the heavy feedstock with superheated steam and the removal of the residual separated liquid. The vaporized hydrocarbons, which contain mostly light volatile hydrocarbons, are subjected to cracking.

In using a flash drum to separate heavy liquid hydrocarbon fractions containing resid from the lighter fractions which can be processed in the pyrolysis furnace, it is important to effect the separation so that nearly all of the non-volatile components will be in the liquid phase. Otherwise, heavy, coke-forming non-volatile components in the vapor are carried into the furnace causing coking problems.

Increasing the cut in the flash drum, or the fraction of the hydrocarbon that vaporizes, is also extremely desirable because resid-containing liquid hydrocarbon fractions generally have a low value, often less than heavy fuel oil. Vaporizing some of the heavier fractions produces more of the valuable steam cracker feed. This can be accomplished by increasing the flash drum (sometimes referred to as a resid knockout vessel) temperature to increase the vaporized cut. However, the resulting vaporized heavier fractions tend to partially condense in the overhead vapor phase resulting in fouling of the lines and vessels downstream of the flash/separation vessel overhead outlet.

Various patents have attempted to address one or more of the above-mentioned drawbacks, problems, or limitations of the conventional steam cracking process.

For example, U.S. Pat. No. 7,138,047, which is incorporated herein by reference, describes an advantageously controlled process to optimize the cracking of volatile hydrocarbons contained in the heavy hydrocarbon feedstocks and to reduce and avoid coking problems. It provides a method to maintain a relatively constant ratio of vapor to liquid leaving the flash by maintaining a relatively constant temperature of the stream entering the flash. More specifically, the constant temperature of the flash stream is maintained by automatically adjusting the amount of a fluid stream and steam mixed with the heavy hydrocarbon feedstock prior to the flash. The fluid can be water.

U.S. Pat. No. 7,220,887, which is incorporated herein by reference, describes a process for cracking hydrocarbon feedstock containing resid comprising: heating the feedstock, mixing the heated feedstock with a fluid and/or a primary dilution steam stream to form a mixture, flashing the mixture to form a vapor phase and a liquid phase which collect as bottoms and removing the liquid phase, separating and cracking the vapor phase, and cooling the product effluent, wherein the bottoms are maintained under conditions to effect at least partial visbreaking. The visbroken bottoms may be steam stripped to recover the visbroken molecules while avoiding entrainment of the bottoms liquid. An apparatus for carrying out the process is also provided.

U.S. Pat. No. 7,247,765, which is incorporated herein by reference, describes a process for cracking hydrocarbon feedstock containing resid comprising: heating the feedstock, mixing the heated feedstock with a fluid and/or a primary dilution steam stream to form a mixture, optionally further heating the mixture, flashing the mixture within a flash/separation vessel to form a vapor phase and a liquid phase, partially condensing the vapor phase by contacting with a condenser within the vessel, to condense at least some coke precursors within the vapor while providing condensates which add to the liquid phase, removing the vapor phase of reduced coke precursors content as overhead and the liquid phase as bottoms, heating the vapor phase, cracking the vapor phase in a radiant section of a pyrolysis furnace to produce an effluent comprising olefins, and quenching the effluent and recovering cracked product therefrom. An apparatus for carrying out the process is also provided.

U.S. Pat. No. 7,419,584, which is incorporated herein by reference, describes a process for cracking hydrocarbon feedstock containing resid comprising: heating the feedstock, mixing the heated feedstock with a fluid and/or a primary dilution steam stream to form a mixture, optionally further heating the mixture, flashing the mixture within a flash/separation vessel to form a vapor phase and a liquid phase, partially condensing the vapor phase by contacting with a condenser within the vessel, to condense at least some coke precursors within the vapor while providing condensates which add to the liquid phase, removing the vapor phase of reduced coke precursors content as overhead and the liquid phase as bottoms, heating the vapor phase, cracking the vapor phase in a radiant section of a pyrolysis furnace to produce an effluent comprising olefins, and quenching the effluent and recovering cracked product therefrom. An apparatus for carrying out the process is also provided.

U.S. Pat. No. 7,193,123, which is incorporated herein by reference, discloses a process for cracking hydrocarbon feedstock containing resid comprising: heating the feedstock, mixing the heated feedstock with a fluid and/or a primary dilution steam stream to form a mixture, flashing the mixture to form a vapor phase and a liquid phase which collect as bottoms and removing the liquid phase, separating and cracking the vapor phase, and cooling the product effluent. The process comprises at least two of the following conditions: (1) maintaining the bottoms under conditions to effect at least partial visbreaking; (2) reducing or eliminating partial vapor condensation during flashing by adding a heated vaporous diluent to dilute and superheat the vapor; (3) partially condensing the vapor within said flash/separation vessel by contacting with a condenser; (4) decoking internal surfaces and associated piping of the flash/separation vessel with air and steam; (5) utilizing a flash/separation vessel having an annular, inverted L-shaped baffle; and (6) regulating temperature in furnace tube banks used for heating by utilizing a desuperheater and/or an economizer. An apparatus for carrying out the process is also provided.

However, it would be desirable to provide a process for enhancing the conversion of materials in the liquid phase in the knockout drum to materials suitable as non-fouling components for the vapor phase, so as to increase the overall efficiency of the cracking operation.

SUMMARY

In a first embodiment, the present application is directed to a process for cracking a hydrocarbon feed in a steam cracking furnace system, comprising withdrawing a resid-rich stream from a resid knockout vessel that is in fluid communication with a furnace convection heating section; and recycling the resid-rich stream through the convection heating section.

The process can further comprise recycling the resid-rich stream by combining it with a hydrocarbon feed for the furnace, forming a mixture stream.

The process can further comprise recycling the resid-rich stream by combining it with a preheated hydrocarbon feed stream exiting the convection heating section, forming a mixture stream.

The process can further comprise preheating the resid-rich stream separately from the hydrocarbon feed in the convection heating section prior to combining it with the preheated hydrocarbon feed stream.

The process can further comprise sparging the mixture stream with dilution steam and/or dilution fluid outside of the furnace, and returning the sparged mixture stream to the convection heating section.

The process can further comprise visbreaking the resid to form hydrocarbon vapor.

The process can further comprise withdrawing a hydrocarbon vapor from the resid knockout vessel, and cracking it.

The process can further comprise passing the resid-rich stream out of the convection section at an upward angle from the horizontal and into the resid-knockout vessel.

The process advantageously results in the visbreaking increasing the level of hydrocarbon vapor by at least about 8% relative to a similar process without the recycling.

The process can further comprise separately sparging the preheated hydrocarbon feed stream and the resid-rich stream with dilution steam and/or dilution fluid, prior to combining the streams.

In another embodiment, the present invention is directed to an apparatus for recycling resid, comprising a steam cracking furnace having a first tube bank having upper and lower sections within a convection heating section of the furnace, a resid knockout vessel disposed outside the furnace in fluid communication with and downstream of an exit of the first tube bank, and a resid recycle pipe in fluid communication with and connected upstream of the resid knockout vessel, such that the recycled resid from the resid knockout vessel is combined with a hydrocarbon feed.

In one aspect of the invention, the resid recycle pipe is connected to a hydrocarbon feed inlet pipe for combining recycled resid with the hydrocarbon feed.

Alternatively, the resid recycle pipe is connected to an exit of the first tube bank lower section, for combining recycled resid with preheated hydrocarbon feed.

The inventive apparatus further comprises a second tube bank having upper and lower sections within the convection heating section, wherein the resid recycle pipe is connected to an inlet of the second tube bank, and an outlet of the second tube bank upper section is connected to an exit of the first tube bank upper section and upstream of the resid knockout vessel.

Additionally, the apparatus can have at least one sparger assembly disposed outside of the furnace and connected between the upper and lower sections of each of the first and second tube banks.

In an advantageous embodiment, the exit of the tube bank is connected to the resid knockout vessel with piping disposed at a rise of at least about 1 foot (0.3 m) per 50 foot (15 m) run, from horizontal.

In another embodiment, the present invention is directed to a system for cracking a hydrocarbon feed, comprising a steam cracking furnace having a hydrocarbon feed inlet pipe, upper and lower convection heating sections, and a radiant section, wherein the upper convection heating section comprises at least a first tube bank having upper and lower sections, the upper section in fluid communication with the inlet pipe, a resid knockout vessel disposed outside the steam cracking furnace and in fluid communication with an exit of the tube bank, and a resid recycle pipe in fluid communication with a bottom of the resid knockout vessel and connected upstream of the resid knockout vessel.

In one aspect of the system, the resid recycle pipe is connected to the hydrocarbon feed inlet pipe.

Alternatively, the resid recycle pipe is connected to an exit of the first upper tube section.

The furnace of the system further comprises a second tube bank having upper and lower sections within the upper convection heating section, wherein the resid recycle pipe is connected to an inlet of the second tube bank upper section, and an outlet of the second tube bank lower section is connected to an exit of the first tube bank lower section and upstream of the resid knockout vessel.

In another embodiment, the system can have at least one sparger assembly disposed outside of the furnace and connected between the upper and lower sections of each of the first and second tube banks.

Advantageously, the exit of the first tube bank is connected to the resid knockout vessel with piping disposed at a rise of at least about 1 foot (0.3 m) per 50 foot (15 m) run, from horizontal.

Conveniently, the system further comprises a vapor stream pipe exiting the resid knockout vessel and connected to a third tube bank within the lower convection heating section.

BRIEF DESCRIPTION OF THE DRAWING

FIG. 1 illustrates a schematic flow diagram of a process and apparatus in accordance with the present invention employed with a pyrolysis furnace.

DETAILED DESCRIPTION OF THE EMBODIMENTS

The description provided below relates to preferred embodiments of the present invention, but alternative embodiments are possible without departing from the invention.

Described herein is a process for cracking a hydrocarbon feed in a steam cracking furnace having a convection heating section, and a resid knockout vessel in fluid communication with the furnace convection section, such as downstream of at least a portion of the convection heating section, such as but not limited to for example downstream of the upper convection section but upstream of the lower convection section, comprising withdrawing a resid-rich stream from the resid knockout vessel (often identified as a vapor/liquid separator); and recycling at least a fraction of the withdrawn resid-rich stream through at least a portion of the convection heating section of the furnace. The process provides significant increases in the conversion of low value, heavy hydrocarbon liquid resid into higher value, lighter hydrocarbon vapor for pyrolysis and conversion into desirable olefins.

By recycling a portion of the knockout drum bottoms, i.e. a resid-rich stream, back to the convection heating section of the steam cracking furnace, the low value resid is further visbroken into shorter hydrocarbon chains and forms higher value light hydrocarbons, which can be more readily vaporized with dilution water/steam to yield more net feed to the pyrolysis section of the furnace.

In previously disclosed steam cracking processes, such as those illustrated in U.S. Pat. Nos. 3,617,493; 7,097,758; 7,138,047; 7,193,123; and 7,220,887, all of which are hereby incorporated by reference in their entireties, various features of a steam cracking furnace incorporating a knockout drum which removes resid are described. Typically, a resid-containing feed enters the furnace at the top of the convection heating section at about 93° C. (200° F.) and is preheated to between about 149° C. (300° F.) to about 260° C. (500° F.). At that point dilution water/steam are mixed with the preheated feed through a dual sparger assembly, and the mixture is further preheated to about 454° C. to about 466° C. (850° F. to 870° F.), which vaporizes the water and roughly 75% or more of the feed. The vapor/heavy hydrocarbon liquid flows out of an upper convection heating section into the knockout drum where the resid-rich liquid falls to the bottom of the drum. The steam/vaporized hydrocarbons passes out of the top of the drum to a lower convection heating section, then to the radiant/pyrolysis section where steam cracking produces high value olefins and di-olefins. The bottoms of the knockout drum is cooled and sent to the refinery as a low value fuel.

The steam cracking operation would be more profitable if more of the bottoms resid were vaporized. In the past it has been known to increase resid vaporization by reducing the hydrocarbon partial pressure within the knockout drum by either increasing the amount of steam in the drum or reducing drum pressure. However, these options have been demonstrated to cause control valve operational problems or to reduce plant capacity. The seemingly simplest solution is to increase the knockout drum temperature; however, raising the temperature accelerates vapor phase cracking reactions, which in turn increases fouling in the drum's overhead piping.

The present inventors have found that recycling the knockout drum bottoms, i.e. a resid-rich stream, back into the convection heating section of the furnace results in a relatively inexpensive process enhancement that increases the net feed that vaporizes in the knockout drum. The drum bottoms is cooled to about 288° C. (550° F.) and is recycled by combining it with the incoming hydrocarbon feed. This combining can occur upstream of the convection heating section, such as by feeding the resid-rich bottoms stream into a hydrocarbon inlet pipe, or after the incoming feed is preheated, for example just before dilution water and/or steam is added. Advantageously, the water/steam addition and the knockout drum visbreaking reactions produce additional lights.

In one embodiment, the resid-rich bottoms stream from the knockout drum is recycled into the hydrocarbon feed inlet pipe to form a hydrocarbon feed/resid mixture stream. In an alternative embodiment, the resid-rich bottoms stream from the knockout drum is recycled into a preheated hydrocarbon feed exiting an upper tube bank of an upper convection heating section, such as downstream of the upper tube bank and upstream of a sparger disposed between upper and lower tube banks within the upper convection heating section of the furnace, to form a hydrocarbon feed/resid mixture stream.

Such recycling of the resid bottoms results in visbreaking of the resid to form additional hydrocarbon vapor, which is fed to the flash separator/resid knockout drum and ultimately back into a lower convection heating section of the furnace for additional heating prior to passing into the radiant section of the furnace.

The present inventors have found that passing the hydrocarbon feed/resid mixture stream out of the convection heating section to the knockout drum at an upward angle, such as through a pipe having a rise of at least about 1 foot/50 foot run (0.3 m rise/15 m run), even about 3 feet/50 foot run (1 m rise/15 m run) relative to horizontal, will enhance the visbreaking reactions and result in additional light hydrocarbons for vaporization and pyrolysis.

In another embodiment, the upper convection heating section has multiple, parallel upper and lower tube banks disposed within it. First upper and lower tube banks are for heating the incoming hydrocarbon feed, and second upper and lower tube banks, which are controlled at a higher temperature relative to the first upper and lower tube banks, are for heating and visbreaking the recycled resid-rich stream. The resid-rich bottoms stream from the knockout vessel can be passed through the second upper tube bank, or through both of the second upper and lower tube banks, and combined into the preheated hydrocarbon feed stream upstream of the resid knockout vessel.

Advantageously, one or more spargers, preferably dual sparger assemblies, can be positioned between and in fluid communication with the upper and lower tube banks, for mixing dilution liquid and/or dilution steam with either or both of the preheated hydrocarbon feed and the recycled resid-rich stream.

In applying this invention, the hydrocarbon feed may be heated by indirect contact with flue gas in a first convection heating section tube bank of the pyrolysis furnace before combining with the resid-rich bottoms stream. Preferably, the temperature of the hydrocarbon feed is from about 150° C. to about 260° C. (300° F. to 500° F.) before mixing with the resid-rich bottoms stream.

The hydrocarbon feed/resid-rich mixture stream can then be heated by indirect contact with flue gas in a first convection heating section of the pyrolysis furnace before being flashed. The first convection heating section is arranged to add a dilution fluid (preferably water), and optionally, primary dilution steam through spargers, between passes of that section such that the hydrocarbon feedstock and the resid-rich stream can be heated before mixing with the fluid/steam and the hydrocarbon feed/resid-rich mixture stream can be further heated before being flashed.

The temperature of the flue gas entering the first convection heating section tube bank is generally less than about 815° C. (1500° F.), for example less than about 700° C. (1300° F.), such as less than about 620° C. (1150° F.), and preferably less than about 540° C. (1000° F.).

Dilution steam may be added at any point in the process, for example, it may be added to the hydrocarbon feedstock before or after heating, to the hydrocarbon feed/resid-rich mixture stream, and/or to the vapor phase. Any dilution steam stream may comprise sour or process steam. Any dilution steam stream may be heated or superheated in a convection heating section tube bank located anywhere within the convection heating section of the furnace.

The hydrocarbon feed/resid-rich mixture stream may be at about 315° C. to about 540° C. (600° F. to 1000° F.) before the flash, and the flash pressure may be about 275 to about 1375 kPa (40 to 200 psia). Following the flash, 50 to 98% of the hydrocarbon feed/resid-rich mixture stream may be in the vapor phase. The vapor phase may be heated above the flash temperature before entering the radiant section of the furnace, for example, from about 425° C. to about 705° C. (800° F. to 1300° F.). This heating may occur in a convection heating section tube bank, preferably the tube bank nearest the radiant section of the furnace.

Unless otherwise stated, all percentages, parts, ratios, etc. are by weight. Unless otherwise stated, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless whether ranges are separately disclosed.

As used herein, non-volatile components, or resids, are the fraction of the hydrocarbon feed with a nominal boiling point above about 590° C. (1100° F.) as measured by ASTM D-6352-98 or D-2887. This invention works very well with non-volatiles having a nominal boiling point above about 760° C. (1400° F.). The boiling point distribution of the hydrocarbon feed is measured by Gas Chromatograph Distillation (GCD) by ASTM D-6352-98 or D-2887 extended by extrapolation for materials boiling above 700° C. (1292° F.). Volatiles can include coke precursors, which are large, condensable molecules that condense in the vapor, and then form coke under the operating conditions encountered in the present process of the invention.

The hydrocarbon feedstock can comprise a large portion, such as about 2 to about 50% of non-volatile components. Such feedstock could comprise, by way of non-limiting examples, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, natural gasoline, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, atmospheric residue, heavy residue, hydrocarbon gases/residue admixtures, hydrogen/residue admixtures, C4's/residue admixture, naphtha/residue admixture, gas oil/residue admixture, and crude oil.

The hydrocarbon feedstock can have a nominal end boiling point of at least about 315° C. (600° F.), generally greater than about 510° C. (950° F.), typically greater than about 590° C. (1100° F.), for example, greater than about 760° C. (1400° F.). The economically preferred feedstocks are generally low sulfur waxy residues, atmospheric residues, various residue admixtures, and crude oils.

In describing the process and apparatus of FIG. 1, those skilled in the art will understand that most, if not all of the indicated piping and apparatus exist as multiple, parallel pipes and apparatuses. For example, hydrocarbon feed inlet pipe 40 is really a series of parallel pipes which feed a series of parallel upper tube banks within the upper convection section, which can be configured to feed a parallel series of spargers, etc.

The preheating of the hydrocarbon feed/resid-rich mixture stream can take any form known by those of ordinary skill in the art. However, as seen in FIG. 1, it is preferred that the heating comprises indirect contact of the hydrocarbon feedstock, either alone or mixed with the resid-rich bottoms stream 31 in the upper (farthest from the radiant section) convection heating section first upper tube bank 2 of the furnace 1 with hot flue gases from the radiant section of the furnace. This can be accomplished, by way of non-limiting example, by passing the hydrocarbon feedstock through a first bank of heat exchange tubes 2 located within the upper convection heating section 3 of the furnace 1. The preheated hydrocarbon feedstock typically has a temperature between about 150° C. and about 260° C. (300° F. to 500° F.), such as between about 160° C. to about 230° C. (325° F. to 450° F.), for example, between about 170° C. to about 220° C. (340° F. to 425° F.).

The preheated hydrocarbon feedstock, either alone or in mixture with the resid-rich stream, is mixed with primary dilution steam and optionally, a dilution fluid 10 that can be a hydrocarbon (preferably liquid but optionally vapor), water, steam, or a mixture thereof. The preferred fluid is water. A source of the fluid can be low-pressure boiler feed water. The temperature of the fluid can be below, equal to, or above the temperature of the heated feedstock.

The mixing of the preheated hydrocarbon feedstock and the fluid 10 can occur inside or outside the pyrolysis furnace 1, but preferably it occurs outside the furnace. The mixing can be accomplished using any mixing device known within the art. For example, it is possible to use a first sparger 4 of a double sparger assembly **9*a* for the mixing. The first sparger 4 can avoid or reduce hammering, caused by sudden vaporization of the fluid 10**, upon introduction of the fluid into the heated hydrocarbon feedstock.

The present invention typically uses steam streams in various parts of the process. The primary dilution steam stream 17 can be mixed with the preheated hydrocarbon feedstock, either alone or mixed with the resid-rich stream 31, as detailed below. In another embodiment, a secondary dilution steam stream 18 can be heated in the convection heating section and mixed with the heated mixture stream 12 before the flash at 19. The source of the secondary dilution steam may be primary dilution steam that has been superheated, optionally, in a convection heating section of the pyrolysis furnace. If coking occurs in the lower convection section, the temperature of the flue gas to the superheater 16 increases, requiring more desuperheater water 26 via valve 25. Either or both of the primary and secondary dilution steam streams may comprise sour or process steam. Superheating the sour or process dilution steam minimizes the risk of corrosion, which could result from condensation of sour or process steam.

In one embodiment of the present invention, in addition to the fluid 10 mixed with the preheated hydrocarbon feedstock, the primary dilution steam 17 is also mixed with the preheated hydrocarbon feedstock either alone or in mixture with the resid-rich recycle stream. The primary dilution steam stream can be preferably injected into a second sparger 8. It is preferred that the primary dilution steam stream is injected into the hydrocarbon fluid mixture before the resulting stream mixture optionally enters the convection heating section at 11 for additional heating by flue gas within the lower tube bank 6.

The primary dilution steam can have a temperature greater, lower or about the same as hydrocarbon feedstock fluid mixture but preferably the temperature is greater than that of the mixture and serves to partially vaporize the feedstock/fluid mixture. The primary dilution steam may be superheated before being injected into the second sparger 8.

The mixture stream comprising the heated hydrocarbon feedstock, the resid-rich stream, the fluid 10, and the primary dilution steam stream leaving the second sparger 8 is optionally heated again in the convection heating section of the pyrolysis furnace 3 before the flash. The heating can be accomplished, by way of non-limiting example, by passing the mixture stream through a lower bank of heat exchange tubes 6 located within the convection heating section, usually as part of the first convection heating section tube bank, of the furnace and thus heated by the hot flue gas from the radiant section of the furnace. The thus-heated mixture stream leaves the convection heating section as a mixture stream 12 to optionally be further mixed with an additional steam stream 19.

Optionally, the secondary dilution steam stream 18 can be further split into a flash steam stream 19 which is mixed with the hydrocarbon mixture 12 before the flash and a bypass steam stream 21 which bypasses the flash of the hydrocarbon mixture and, instead is mixed with the vapor phase from the flash 13 before the vapor phase is cracked in the radiant section of the furnace. The present invention can operate with all secondary dilution steam 18 used as flash steam 19 with no bypass steam 21. Alternatively, the present invention can be operated with secondary dilution steam 18 directed to bypass steam 21 with no flash steam 19. In a preferred embodiment in accordance with the present invention, the ratio of the flash steam stream 19 to bypass steam stream 21 should be preferably 1:20 to 20:1, and most preferably 20:1 to 10:1. In this embodiment, the flash steam 19 is mixed with the hydrocarbon/resid-rich mixture stream 12 to form a flash stream, which typically is introduced before the flash separator/knockout vessel 5 through large pipe 20. Preferably, the secondary dilution steam stream is superheated in a superheater section 16 in the furnace convection before splitting and mixing with the hydrocarbon mixture. The addition of the flash steam stream 19 to the hydrocarbon mixture stream 12 aids the vaporization of most volatile components of the mixture before the flash stream enters the flash/separator vessel 5 through large pipe 20.

In one advantageous embodiment, the flash stream is conducted through large pipe 20 at an upward angle θ, defined by a rise of at least about 1 foot/50 foot run (0.3 m/15 m), or even a rise of at least about 3 feet/50 foot run (1 m/15 m), relative to horizontal. This slight upflow to the flash separator/knockout vessel 5 significantly increases the liquid flow area, residence time, visbreaking reactions, and thereby the fraction of resid recycle that vaporizes. For example, instead of being level (horizontal), if the large pipe 20 has an upgrade of 1 ft/50 ft (0.3 m/15 m), visbreaking reactions increase by as much as 18%, relative to a level pipe. At an upgrade of 3 ft/50 ft (1 m/15 m), visbreaking reactions increase by as much as 50%, relative to a level pipe.

The mixture stream 12 or the flash stream in pipe 20 is then introduced for flashing, either directly or through a tangential inlet (to impart swirl) to a flash separator/resid knockout vessel 5, for separation into two phases: a vapor phase comprising predominantly volatile hydrocarbons and steam and a liquid phase comprising predominantly non-volatile hydrocarbons, including resid. The vapor phase is preferably removed from the separator/resid knockout vessel as an overhead vapor stream 13. The vapor phase, preferably, is fed back to lower convection heating section tube banks 23 of the furnace, preferably located nearest the radiant section of the furnace, for additional heating and through crossover pipes 24 to the radiant/pyrolysis section of the pyrolysis furnace (not shown) for cracking. The liquid phase of the flashed mixture stream is removed from the flash/separator vessel 5 as a bottoms stream 27, which can be split into the resid-rich recycle stream 31, a cooled liquid quench stream 30, and an export resid-rich stream 22.

The flash separator/resid knockout vessel 5 is generally operated, in one aspect, to avoid coking of the non-volatiles in the liquid phase. Use of the secondary dilution steam stream 18 in the flash stream entering the flash separator/resid knockout vessel reduces the partial pressure of the hydrocarbons in the vapor phase (i.e., a larger mole fraction of the vapor is steam) and thus avoids having to raise the liquid phase temperature to vaporize additional volatiles. It may also be helpful to recycle a portion of the externally cooled flash/separator vessel bottoms liquid 30 back to the flash separator/resid knockout vessel to help cool the newly separated liquid phase at the bottom of the vessel. Stream 27 can be conveyed from the bottom of the vessel 5 to the cooler 28 via pump 37. The cooled stream 29 can then be split into cooled liquid quench stream 30 that quenches hot bottoms in the boot of drum 5, a second recycle stream 31 that is recycled to the upper convection section according to the present invention, and export stream 22. The temperature of the recycled stream would typically be about 260° C. to about 315° C. (500° F. to 600° F.), for example, about 270° C. to about 290° C. (520° F. to 550° F.). The amount of recycled stream can be from about 80 to about 250% of the amount of the newly separated bottom liquid inside the flash/separator vessel, such as from about 90 to about 225%, for example, from about 100 to about 200%.

It is preferred to maintain a predetermined constant ratio of vapor to liquid in the flash separator/resid knockout vessel 5, but such ratio is difficult to measure and control. As an alternative, temperature of the hydrocarbon feed/resid-rich mixture stream 12 before the flash separator/resid knockout vessel 5 can be used as an indirect parameter to measure, control, and maintain an approximately constant vapor to liquid ratio in the flash separator/resid knockout vessel 5. Ideally, when the mixture stream temperature is higher, more hydrocarbons will be vaporized and become available as a vapor phase for cracking. However, when the hydrocarbon feed/resid-rich mixture stream temperature is too high, more heavy hydrocarbons will be present in the vapor phase and carried over to the convection furnace tubes, eventually coking the tubes. If the mixture stream 12 temperature is too low, resulting in a low ratio of vapor to liquid in the flash separator/resid knockout vessel 5, more volatile hydrocarbons will remain in liquid phase and thus will not be available for cracking.

The hydrocarbon feed/resid-rich mixture stream temperature is limited by highest recovery/vaporization of volatiles in the feedstock while avoiding excessive coking in the furnace tubes or coking in piping and vessels conveying the vaporized lights from the hydrocarbon feed/resid-rich mixture from the flash separator/resid knockout vessel to the furnace 1 via line 13. The pressure drop across the vessels and piping 13 conveying the vaporized lights from the hydrocarbon feed/resid-rich mixture to the lower convection heating section 23, and the crossover piping 24, and the temperature rise across the lower convection heating section 23 may be monitored to detect the onset of coking problems. For instance, when the crossover pressure and process inlet pressure to the lower convection heating section 23 begins to increase rapidly due to coking, the temperature in the flash separator/resid knockout vessel 5 and the hydrocarbon feed/resid-rich mixture stream 12 should be reduced. If coking occurs in the lower convection heating section, the temperature of the flue gas to the superheater 16 increases, requiring more desuperheater water 26 via valve 25. Control valve 36 can also be used to help maintain a constant pressure in the flash separator/resid knockout vessel 5.

The selection of the hydrocarbon feed/resid-rich mixture stream 12 temperature is also determined by the composition of the feedstock materials. When the feedstock contains higher amounts of lighter hydrocarbons, the temperature of the mixture stream 12 can be set lower. As a result, the amount of fluid 10 used in the first sparger 4 would be increased and/or the amount of primary dilution steam 17 used in the second sparger 8 would be decreased since these amounts directly impact the temperature of the mixture stream 12. When the feedstock contains a higher amount of non-volatile hydrocarbons, the temperature of the mixture stream 12 should be set higher. As a result, the amount of fluid used in the first sparger 4 would be decreased while the amount of primary dilution steam used in the second sparger 8 would be increased. By carefully selecting a mixture stream temperature, the present invention can find applications with a wide variety of feedstock materials.

The temperature of hydrocarbon feed/resid-rich mixture stream 12 can be controlled by a control system 7 which comprises at least a temperature sensor and any known control device, such as a computer application. Preferably, the temperature sensors are thermocouples. The control system 7 communicates with the dilution fluid valve 14 and the primary dilution steam valve 15 so that the amount of the dilution fluid and the primary dilution steam entering the two spargers can be controlled. The specifics of operating such a control system are set forth in U.S. Pat. No. 7,138,047.

In an alternative embodiment of the present process, all or a portion of resid-rich bottoms recycle stream 31 can optionally be split off into pipe 32 to direct the resid-rich stream into the preheated hydrocarbon feed downstream of the upper tube bank 2 and upstream of the double sparger assembly 9*a*, where the mixture stream can be sparged with steam and/or dilution fluid. Alternatively, the resid-rich bottoms recycle stream can be directed through pipes 31 and 32 and fed into a separate sparger 9*b*, void of hydrocarbon feed, so as to separately control its temperature from that of the preheated hydrocarbon feed stream in sparger 9*a*.

In another alternative embodiment of the present invention, the resid-rich knockout vessel recycle stream 31 can be introduced into the upper convection heating section 3 of furnace 1 separately through a parallel inlet pipe 40. The incoming hydrocarbon feed is preheated in a first upper tube bank 2, while the resid-rich recycle stream is heated in a second, parallel upper tube bank 2, which is maintained at a higher temperature relative to the first upper tube bank 2, by for example selecting a tube bank towards the center of the convection heating section, which stays hotter as compared to tube banks closer to the walls of the furnace.

According to this embodiment, the preheated hydrocarbon feed exits the first upper tube bank and passes through a first dual sparger assembly 9*a*, wherein dilution liquid 10 is passed through control valve 14 and into sparger section 4, and primary dilution steam stream 17 passes through control valve 15 and into sparger section 8, thus mixing either or both of the dilution liquid 10 and the primary dilution steam 17 with the preheated hydrocarbon feed. In a similar manner, the resid-rich stream 31/40 enters a second, parallel upper tube bank 2, is preheated to a temperature above that of the preheated hydrocarbon feed, exits the second upper tube bank and upper convection heating section to be mixed with dilution fluid and primary dilution steam through a second, parallel dual sparger assembly 9*b*.

Then the diluted hydrocarbon feed and the diluted resid-rich stream both are directed back into the upper convection heating section 3 through parallel first and second lower tube banks 6, respectively for further preheating. At this point visbreaking of the resid-rich stream begins to take place. The two streams exit the lower tube banks 6 to form flash streams 12 where they can be combined and mixed.

In a similar manner to the first described embodiment, the hydrocarbon feed/resid-rich mixture stream is conducted to flash separator/knockout drum 5 through large pipe 20, preferably at an upflow angle θ, as described above.

In another embodiment, the invention is directed to a process for cracking a hydrocarbon feed in a steam cracking furnace having a hydrocarbon feed inlet pipe for introducing a hydrocarbon feed to an upper convection heating section of the furnace, and a resid knockout vessel downstream of the upper convection heating section, comprising withdrawing a resid-rich stream from the resid knockout vessel; and recycling the resid-rich stream through the upper convection heating section.

The process can further comprise mixing the resid-rich stream with the hydrocarbon feed in the inlet pipe, forming a hydrocarbon feed/resid mixture stream.

The process can further comprise mixing the resid-rich stream with the hydrocarbon feed exiting an upper tube bank of the upper convection heating section, forming a hydrocarbon feed/resid mixture stream.

The process can further comprise feeding the hydrocarbon feed/resid mixture stream into a sparger disposed downstream of the first upper tube bank.

The process can further comprise sparging the hydrocarbon feed/resid mixture stream with dilution fluid and/or dilution steam and passing the resulting mixture back into the upper convection heating section.

The process can further comprise visbreaking the resid, forming hydrocarbon vapor.

The process can further comprise cracking the visbroken hydrocarbon vapor in a pyrolysis section of the furnace.

The process can further comprise passing the hydrocarbon feed/resid mixture stream from the upper convection heating section at an upward angle into the resid-knockout vessel, to enhance visbreaking of the resid, wherein the upward angle is a rise of at least about 1 foot per 50 foot run (0.3 m/15 m).

The visbreaking of the resid results in an increase of hydrocarbon vapor in the resid knockout vessel of at least about 8% relative to a similar process without the recycling of resid.

The process can further comprise heating the resid-rich stream and the hydrocarbon feed stream separately within the upper convection heating section of the furnace.

The process can further comprise separately sparging the hydrocarbon feed stream and the resid-rich stream exiting the upper convection heating section in separate spargers with dilution steam and/or dilution fluid, prior to mixing the streams.

EXAMPLE

Table 1 below contains data calculated from a model which assumes a conservative estimate of 38% vaporization of the once recycled bottoms, but models predict that 38 to 50% of the once recycled bottoms will vaporize.

TABLE 1

| Recycle:Feed Ratio | Net Vapor Cut | Mixed Feed MNI (wt %) | Bottoms MNI (wt %) | % Bottoms in $7^{th}$ recycle |
|---|---|---|---|---|
| 0 | 75 | 1.0 | 3.2 | 0 |
| 0.05 | 76.8 | 1.1 | 3.4 | 0.0 |
| 0.18 | 81.5 | 1.5 | 4.0 | 0.08 |
| 0.30 | 85.2 | 2.0 | 5.3 | 1.1 |
| 0.50 | 89.6 | 4.0 | 10.0 | 8.6 |
| 1.00 | 93.5 | 12.2 | 23.5 | 37 |

In a continuous process, the original bottoms will recycle several times before exiting the process. Each time less of the bottoms vaporizes with the remaining bottoms becoming more refractory as measured by the Modified Naphtha Insolubles (MNI) test. Table 1 shows how the net cut (or % vaporized) increases as the recycle flowrate increases. Table 1 also shows the predicted concentration of MNI in the mixed feed and bottoms. In these examples, the fresh feed is assumed to contain 1% MNI.

Also of interest is the highest concentration of the refractory resid in the bottoms. Models predict that each recycle pass increases the MNI concentration by roughly 40%. Less and less of the bottoms vaporizes during each successive pass through the convection heating section. It is conservatively estimated that after the bottoms has recycled 7 times through the convection heating section, that no further resid can vaporize and the bottoms MNI concentration is 50%. The far right column of Table 1 lists the percentage of the bottoms which has recycled 7 times.

The data in Table 1 reveals that even a small recycle rate can significantly increase the net vapor cut in the knockout vessel. For example, when the recycle flowrate increases from zero to 18% of the fresh feed flowrate (the "Recycle:Feed Ratio"), the net cut increases from 75 to 81.5%. The MNI in the mixed feed and bottoms are 1.5 and 4.0%, respectively. Successful commercial operations have been demonstrated on feeds with up to 3% MNI. Only 0.08% of the bottoms is 7 times recycled and may contain a trace of solids, which can readily be removed in the bottoms cooling system to prevent their recycle.

At moderate recycle flowrates, the cut enhancement is highly dependent on only the percentage of the bottoms that vaporizes during the first recycle. While Table 1 is based on only 38% vaporization of the once recycled bottoms, models predict that 38 to 50% of the once recycled bottoms will vaporize. At 50% the cut enhancement can be about 30% greater than shown in Table 1. Assuming that only 38% of the recycled bottoms vaporizes and an 18:100 recycle:feed ratio, furnace simulations show that the knockout vessel temperature remains constant without having to adjust the ratio of cooling fluid 10 (preferably water) to primary dilution steam 17 in the convection section. Thus, recycling bottoms will have only a small negative impact on furnace capacity.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

In another embodiment, this invention relates to:

1. A process for cracking a hydrocarbon feed in a steam cracking furnace system, comprising withdrawing a resid-rich stream from a resid knockout vessel that is in fluid communication with a furnace convection heating section; and recycling the resid-rich stream through the furnace convection heating section.
2. The process of paragraph 1, further comprising recycling the resid-rich stream by combining it with a hydrocarbon feed for the furnace, forming a mixture stream.
3. The process of paragraph 1, further comprising recycling the resid-rich stream by combining it with a preheated hydrocarbon feed stream exiting the convection heating section, forming a mixture stream.
4. The process of paragraph 1 or 3, further comprising preheating the resid-rich stream separately from the hydrocarbon feed in the convection heating section prior to combining it with the preheated hydrocarbon feed stream.
5. The process of paragraph 2 or 3, further comprising sparging the mixture stream with dilution steam and/or dilution fluid outside of the furnace, and returning the sparged mixture stream to the upper convection heating section.
6. The process of any preceding paragraph, further comprising visbreaking the resid to form hydrocarbon vapor.
7. The process of any preceding paragraph, further comprising withdrawing a hydrocarbon vapor from the resid knockout vessel, and cracking it.
8. The process of any preceding paragraph, further comprising passing the resid-rich stream out of the convection section at an upward angle from the horizontal and into the resid-knockout vessel.
9. The process of paragraphs 1 or 3-8, further comprising separately sparging the preheated hydrocarbon feed stream and the resid-rich stream with dilution steam and/or dilution fluid, prior to combining the streams.
10. An apparatus for conducting a process according to paragraph 1, comprising a steam cracking furnace having a first tube bank having upper and lower sections within a convection heating section of the furnace; a resid knockout vessel disposed outside the furnace in fluid communication with and downstream of an exit of the first tube bank; and a resid recycle pipe in fluid communication with a bottom of the resid knockout vessel and connected upstream of the resid knockout vessel, such that the recycled resid from the resid knockout vessel is combined with a hydrocarbon feed.

11. The apparatus of paragraph 10, wherein the resid recycle pipe is connected to a hydrocarbon feed inlet pipe for combining recycled resid with the hydrocarbon feed.
12. The apparatus of paragraph 10, wherein the resid recycle pipe is connected to an exit of the first tube bank lower section, for combining recycled resid with preheated hydrocarbon feed.
13. The apparatus of paragraph 10 or 12, further comprising a second tube bank having upper and lower sections within the convection heating section, wherein the resid recycle pipe is connected to an inlet of the second tube bank, and an outlet of the second tube bank upper section is connected to an exit of the first tube bank upper section, upstream of the resid knockout vessel.
14. The apparatus of paragraph 13, further comprising at least one sparger assembly disposed outside of the furnace and connected between the upper and lower sections of each of the tube banks.
15. The apparatus of any of paragraphs 10-14, wherein the exit of the first tube bank is connected to the resid knockout vessel with piping disposed at a rise of at least about 1 foot per 50 foot run (0.3 m/15 m), relative to horizontal.

The invention claimed is:

1. A process for cracking a hydrocarbon feed in a steam cracking furnace system, comprising:

withdrawing a resid-rich stream from a resid knockout vessel that is in fluid communication with a furnace convection heating section; and recycling said resid-rich stream through said convection heating section.

2. The process of claim 1, further comprising recycling said resid-rich stream by combining it with a hydrocarbon feed for said furnace, forming a mixture stream.

3. The process of claim 2, further comprising sparging said mixture stream with dilution steam and/or dilution fluid outside of said furnace, and returning said sparged mixture stream to said convection heating section.

4. The process of claim 1, further comprising recycling said resid-rich stream by combining it with a preheated hydrocarbon feed stream exiting said convection heating section, forming a mixture stream.

5. The process of claim 4, further comprising preheating said resid-rich stream separately from said hydrocarbon feed in said convection heating section prior to combining it with said preheated hydrocarbon feed stream.

6. The process of claim 5, further comprising separately sparging said preheated hydrocarbon feed stream and said resid-rich stream with dilution steam and/or dilution fluid, prior to combining said streams.

7. The process of claim 4, further comprising sparging said mixture stream with dilution steam and/or dilution fluid outside of said furnace, and returning said sparged mixture stream to said convection heating section.

8. The process of claim 7, wherein said visbreaking increases the level of hydrocarbon vapor by at least about 8% relative to a similar process without said recycling.

9. The process of claim 1, further comprising visbreaking said resid to form hydrocarbon vapor.

10. The process of claim 1, further comprising withdrawing a hydrocarbon vapor from said resid knockout vessel, and cracking it.

11. The process of claim 1, further comprising passing said resid-rich stream out of said convection section at an upward angle from the horizontal and into said resid-knockout vessel.

* * * * *